US010182637B2

(12) United States Patent
Eisenberg

(10) Patent No.: US 10,182,637 B2
(45) Date of Patent: Jan. 22, 2019

(54) FACIAL MASK

(71) Applicant: Anita Eisenberg, Los Angeles, CA (US)

(72) Inventor: Anita Eisenberg, Los Angeles, CA (US)

( * ) Notice: Subject to any disclaimer, the term of this patent is extended or adjusted under 35 U.S.C. 154(b) by 669 days.

(21) Appl. No.: 14/616,735

(22) Filed: Feb. 8, 2015

(65) Prior Publication Data

US 2016/0227905 A1 Aug. 11, 2016

(51) Int. Cl.
*A45D 44/00* (2006.01)

(52) U.S. Cl.
CPC .... *A45D 44/002* (2013.01); *A45D 2200/1027* (2013.01); *A45D 2200/1036* (2013.01)

(58) Field of Classification Search
CPC ..... A61K 8/0212; A45D 2200/1027; A45D 44/002; A45D 2200/1036
See application file for complete search history.

(56) References Cited

FOREIGN PATENT DOCUMENTS

CN 2635123 Y * 8/2004 ..... A61M 35/00
WO WO 2009135336 A1 * 11/2009 ..... A45D 44/002

OTHER PUBLICATIONS

Aperature per Merriam Webster Dictionary.*

* cited by examiner

*Primary Examiner* — Leslie Deak
*Assistant Examiner* — Gabriella Burnette
(74) *Attorney, Agent, or Firm* — Raymond Y. Chan; David and Raymond Patent Firm

(57) ABSTRACT

A facial mask includes a mask body impregnated with a cosmetic composition and a composition retention structure for retaining the cosmetic composition in the mask body. The mask body includes a facial mask layer and a holding device including at least two ear mask layers integrally extended from two side portions of the facial mask layer and/or a chin mask layer integrally extended from a bottom portion of the facial mask layer, adapted for overlaying on the skin surfaces of the face, the ears and/or the chin of the user respectively for skin care treatment of the facial skin surface of the user while the holding device is adapted for wearing the facial mask layer on the user's face by holding to the ears of the user.

11 Claims, 6 Drawing Sheets

FACIAL MASK

This is a Continuation-In-Part application that claims the benefit of priority under 35 U.S.C. § 119 to a U.S. non-provisional application, application No. 29/463,662, filed Feb. 3, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a skin care product, and more particularly to a wearable facial mask, wherein the user is able to wear the facial mask to ensure the cosmetic composition contacts the facial skin of the user.

Description of Related Arts

Facial masks are cosmetic products which have been used for many years for skin care treatment. Existing facial masks generally consist of a main portion of natural or synthetic sheet material impregnated with nutrient solution. The main portion is sized and shaped to cover the entire face of a user and to have holed openings provided corresponding to the mouth, nose and eyes of the user, wherein the main portion of the facial mask is preferably made of water-permeable, fibrous and various woven or nonwoven materials in a suitable thickness. While the main portion of the facial mask impregnated with nutrient liquid solution is applied on the user's face, the nutrient liquid solution can be applied directly onto the skin of the user's face.

Furthermore, most of the conventional facial masks are made in sheet-like structure limiting their flexibility and functionality. It is impossible for the facial masks to completely conform to the user's face in a three-dimension configuration. Once the facial mask is applied on the user's face, his or her head is preferred to remain in a stationary position and the user is preferred not to move around actively to avoid the conventional mask sliding off the user's face from the lubrication of nutrients on the skin with gravity. In other words, the user is conformed to remain at a sitting or laying position during the application of the facial mask. In addition, due to the limited size and shape of the conventional facial mask, a portion of the user's skin, between the edge of the mask and along the user's jawline, is not covered by the mask and remains exposed to the air and not held in an enclosed wrapped lifted compressed manner.

Accordingly, the conventional facial masks are only designed to cover the skin of the main area of the center portion of the user's face and other parts of the body separately. Therefore, additional neck masks are available in the current market. The user needs to purchase the facial mask for skin care of his or her face and the neck mask for the skin of his or her neck respectively. It becomes an additional expense for the users to purchase separate products to take care of their skin.

In order to maintain the absorption efficiency of the facial masks, a large amount of nutrition liquid should be impregnated into the main portion of the facial mask. However, when the main portion of the facial mask is applied on the skin of the user's face, the nutrition liquid will drop down from the facial mask due to gravity. It is a waste for the excessive nutrition liquid if the nutrition liquid is not being completely absorbed by the skin of the user. Sometimes, the excessive nutrition liquid may drop from the facial mask and damage the user's clothes. In order to enhance the liquid retention power of the facial mask, the facial mask can be made of a material with high liquid absorption ability or simply increase its thickness so as to retain more nutrition liquid in the facial mask. On the other hand, as a disposable product, such conventional facial mask made of high liquid absorption material or thickened facial mask has a relatively higher material cost. In fact, it is not a good idea for the facial mask to be too thick because it will increase the weight of the mask and make it harder to be snuggly fitted and applied onto the user's face. Also, since the conventional facial mask fails to be effectively applied on the user's face and to ensure all the nutrition liquid is being absorbed by the user's skin, the excessive nutrition liquid soaked in the facial mask substantially increases its manufacturing cost. The limited materials available sometimes dries too quickly, limiting the amount of time the user can undergo treatment. Also these are disposable material and can't be reused or washed in a washer.

SUMMARY OF THE PRESENT INVENTION

An object of the present invention is to provide a facial mask, wherein the user is able to securely wear the facial mask on his or her face and to ensure the cosmetic composition is in good, firm and direct contact with the skin of the user's face.

Another object of the present invention is to provide a facial mask wherein mask body is able to cover not only the skin surface of the user's face but also the rear ear skin surfaces and chin surface of the user.

Another object of the present invention is to provide a facial mask which further comprises two ear mask layers integrally extended from or provided at two side portions of the facial mask layer, such that the two ear mask layers are made to be held by the ears of the user and to cover the two rear ear skin surfaces of the user respectively while ensuring the facial mask layer covers the skin surface of the user's face.

Another object of the present invention is to provide a facial mask, wherein when the ear mask layers are held by the ears of the user respectively, two opposite forces are relatively applied to the mask body to slightly stretch it from a center axis thereof, so as to provide a better and more complete compression contact of the mask body with the skin of the user's face for security of placement and comfort. It not only ensures better absorption of the nutrition liquid within the skin but also enables the user to move around while wearing the facial mask of the present invention without apprehension of the facial mask dropping or sliding off.

Another object of the present invention is to provide a facial mask which may further comprise a chin mask layer for covering a chin skin surface of the user under his or her jaw, wherein the two ends of the chin mask layer are arranged to be held at the ears of the user respectively or around the neck of the user so as to ensure the chin mask layer is in good contact with the chin skin surface of the user and the mask body is securely held on the user's face.

Another object of the present invention is to provide a facial mask, wherein the mask body comprises a composition retention structure for retaining the cosmetic composition and/or nutrition liquid therein by means of surface tension so as to enhance the liquid retention ability of the mask body.

Another object of the present invention is to provide a facial mask, wherein the mask body has a nose cover provided corresponding to the user's nose for covering the skin of the user's nose when the mask body is applied on the user's face.

Another object of the present invention is to provide a facial mask, wherein the user is able to freely move and talk (enabling movement of facial muscles) while wearing the facial mask of the present invention, such that the user can continue his or her work or activities while applying the facial mask.

Another object of the present invention is to provide a facial mask which can be made re-useable, wherein the mask body can be washed and dried and soaked with a predetermined cosmetic composition and/or nutrition liquid composition for a next application.

Another object of the present invention is to provide a facial mask which comprises a wearing arrangement adapted to be worn on the user's face so as to render the facial mask becoming a mask holder for cosmetic applications on a user's face. For example, it enables a user to apply gel layers of a cosmetics application overnight. In one embodiment, the wearing arrangement of the facial mask comprises two ear mask layers adapted for loop attachment with the two ears of the user respectively and/or chin mask layer adapted for attaching to the ears or connecting around the neck of the user, so as to wear the facial mask on the user's face.

Another object of the present invention is to provide a wearable facial mask, wherein no expensive and complicated structure and configuration is required to be employed in order to achieve the above mentioned objects. Therefore, the present invention successfully provides an economic and efficient solution that allows the facial mask to be worn by the user during application.

According to the present invention, the foregoing and other objects and advantages are attained by a wearable facial mask which comprises a mask body impregnated with a cosmetic composition.

The mask body comprises a facial mask layer which has a plurality of openings, including partial openings and/or optional flaps, provided in approximate size and position corresponding to a user's eyes, nose and mouth, and two ear mask layers integrally extended from two side portions of the facial mask layer adapted for covering two rear ear skin surfaces of the user respectively, wherein the two ear mask layers are made to be able to be held at the two ears of the user so as to securely wear the facial mask on the user's face while ensuring the facial mask layer covers the skin surface of the user's face. Therefore, when the mask body is worn on the face of the user by the ears of the user, the cosmetic composition can be adapted for treatment of the skin surface of the user's face as well as the rear ear skin surfaces of the user.

In one embodiment, the facial mask comprises a wearing arrangement including two ear holders, wherein the two ear holders are the two ear mask layers each providing a cutted slot therein so that the two ear mask layers are capable of looping over the two ears of the user by placing the two ears through the two cutted slots respectively.

In accordance with another aspect of the invention, the present invention comprises a wearable and reusable facial mask comprising a mask body which is made of absorbent fabric, including various types of stretchable fiber, for impregnating with a cosmetic composition.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figures 1, 3:
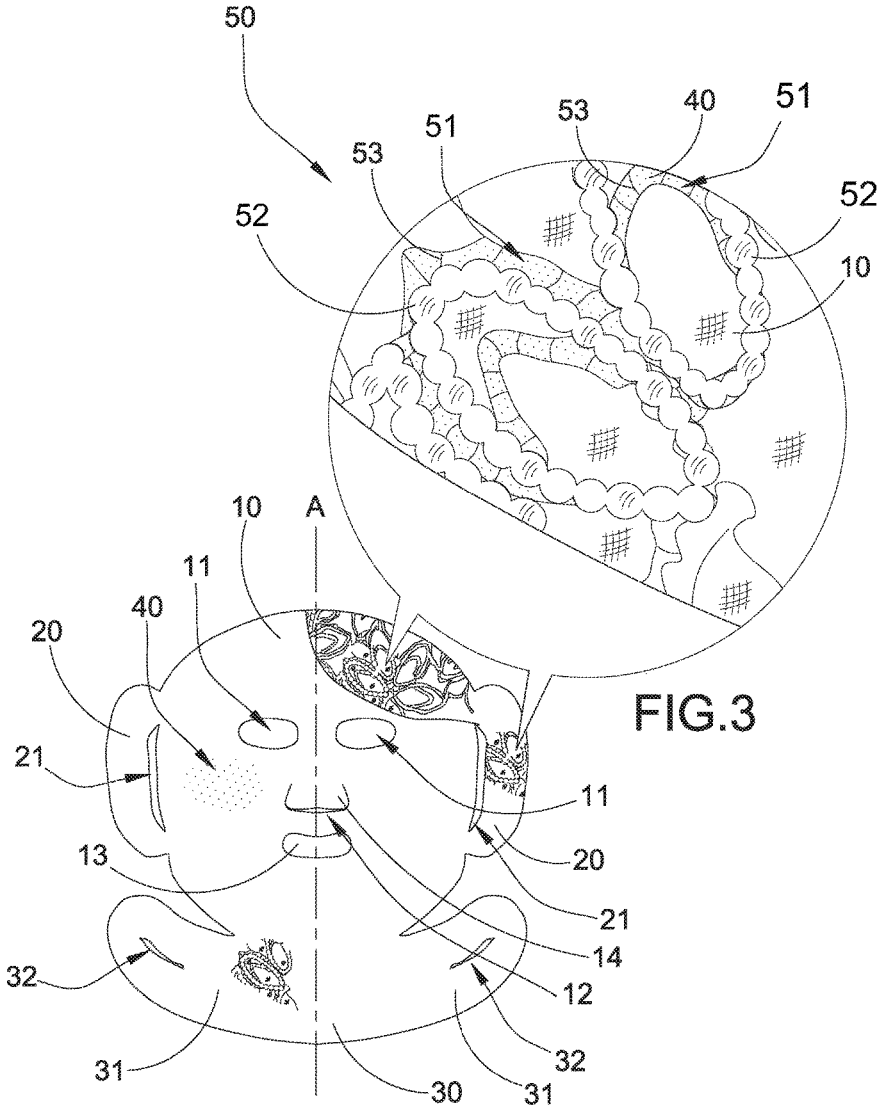
FIG. 1 is a perspective view of the facial mask according to a preferred embodiment of the present invention.
FIG. 3 is a partially enlarged view of the facial mask according to the above preferred embodiment of the present invention, illustrating the composition retention structure.
Figure 2:
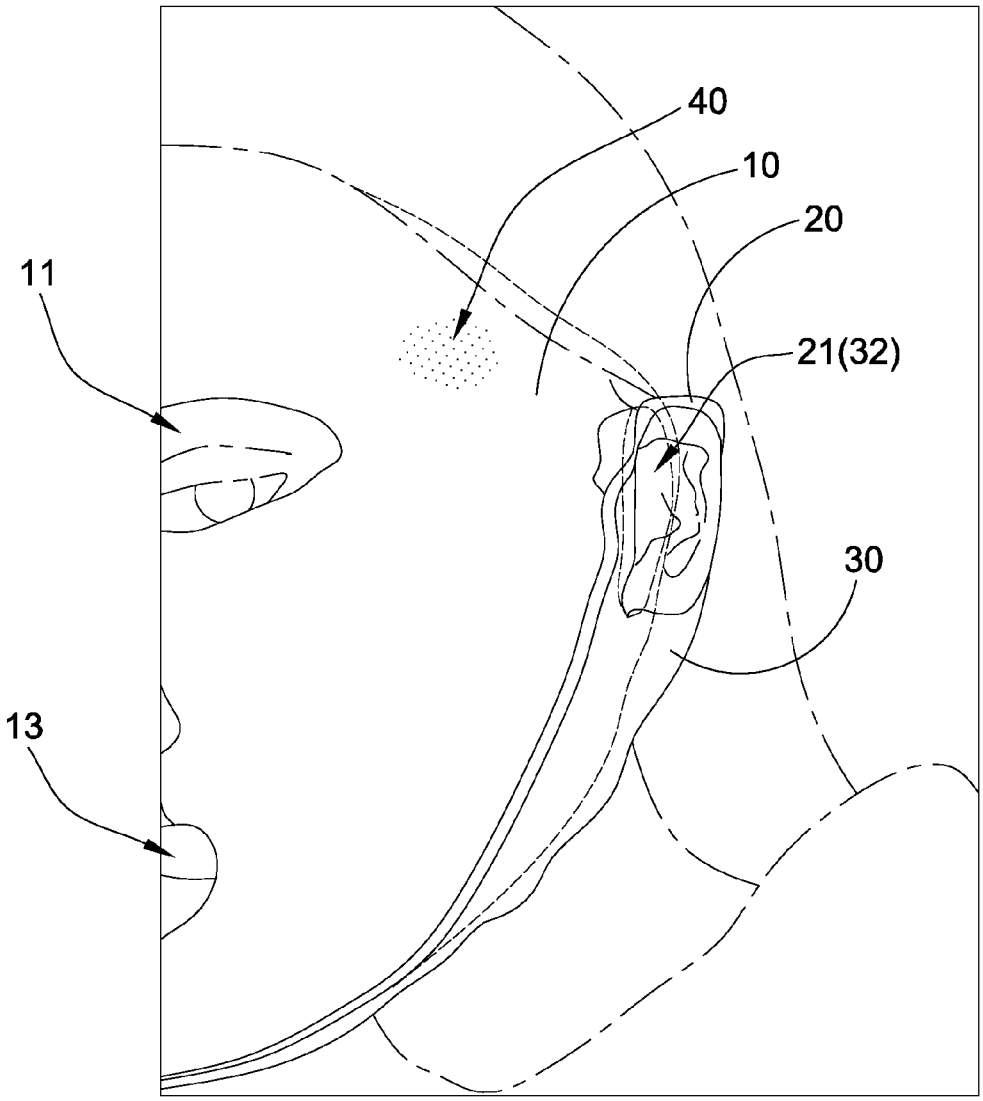
FIG. 2 is a perspective view of the facial mask according to the above preferred embodiment of the present invention, illustrating the user wearing the facial mask.

Referring to FIG. 1 to FIG. 2 of the drawings, a facial mask according to a preferred embodiment of the present invention is illustrated, wherein the facial mask, which is a wearable mask that can be worn on the face of a user, comprises a mask body impregnated with a cosmetic composition 40. The mask body comprises a facial mask layer 10 and a holding device which comprises two ear mask layers 20 and a chin mask layer 30.

Figure 4:
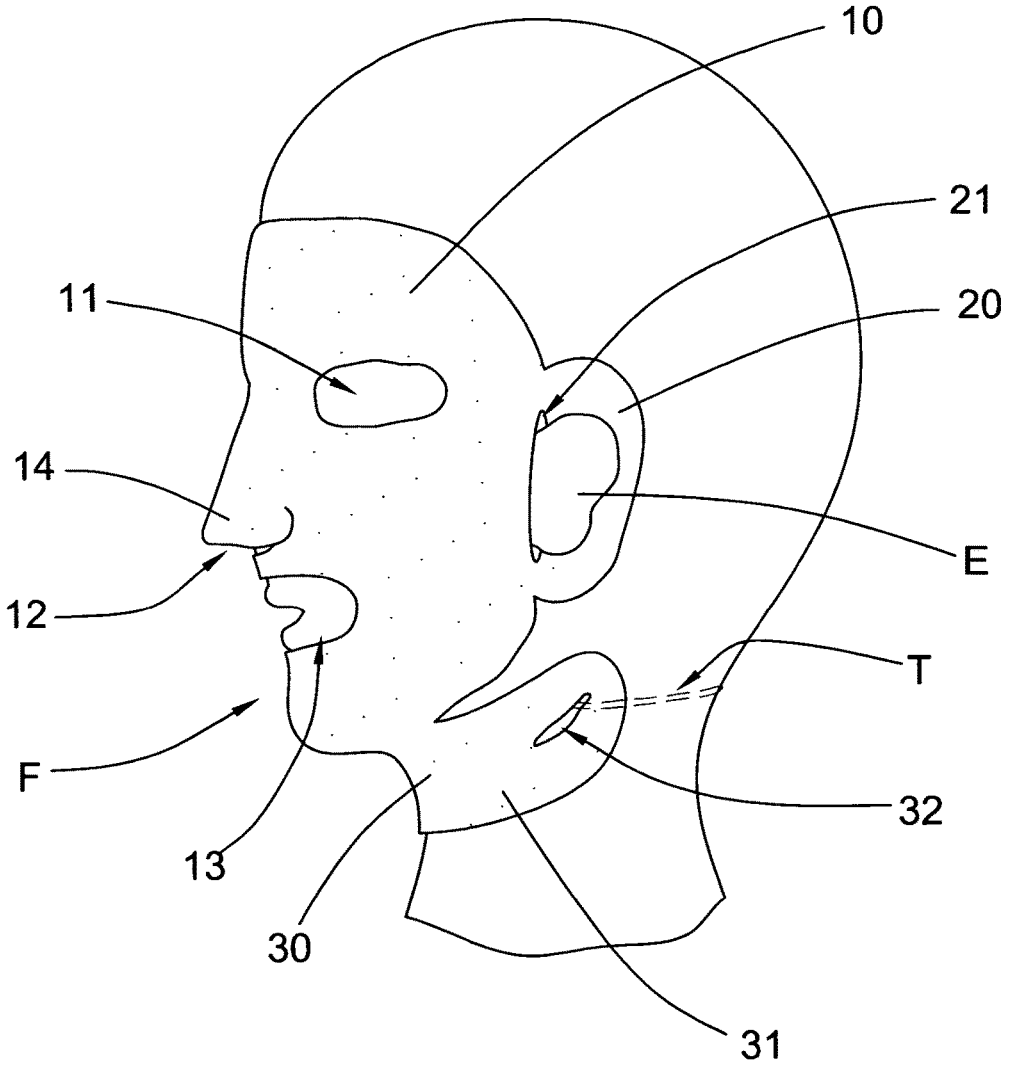
FIG. 4 is a side view of the facial mask applied to the user according to the above preferred embodiment of the present invention, illustrating the facial mask worn on the face of a user by looping and hanging at the ear of the user.

As shown in FIGS. 1, 2 and 4, the facial mask layer 10, which is sized and shaped corresponding to the face of the general user adapted for wearing on the face of the user while enabling the user to breathe normally. According to the preferred embodiment, the facial mask layer 10 has a plurality of openings positioned and shaped corresponding to the size and position of the user's eyes, nose and mouth, wherein the openings include two eye openings 11, a nose opening 12, and a mouth opening 13, which are pre-formed on the facial mask layer 10 in such a manner that when the facial mask layer 10 is applied to place on the face of the user, the eye openings 11, the nose opening 12 and the mouth opening 13 should be aligned with the two eyes, nose, and mouth of the user respectively so as to enable the eyes, nose and mouth of the user to communicate.

In particular, the facial mask layer 10 further comprises a U-shaped nose cover 14 movably formed above the nose opening 12 for covering a nose surface, including the nose wings, of the user without covering the nostrils of the user, as shown in FIGS. 1 and 4. It is preferred that the entire skin surface of the face of the user is covered by the facial mask layer 10.

The two ear mask layers 20 are integrally extended from two side portions of the facial mask layer 10, or provided at the two side portions of the facial mask layer 10 if the two side portions are large enough to reach the ears of the user, for being extended to rear portions of the two ears respectively for covering the rear skin surfaces of the two ears of the user respectively so that even the rear skin surfaces of the user's ears can be provided with facial care treatment by the facial mask. In particular, when the ear mask layers 20 are held at the ears of the user respectively, the mask body is worn. In other words, the ear mask layers 20 provide multiple functions of enabling the facial mask layer 10 to be worn on the facial skin surface of the user and of providing a treatment of the ear skin surfaces of the user. It is worth mentioning that the ears of the user are high risk areas for getting sunburned. The cosmetic composition 40 impregnated with the ear mark layers 20 can ameliorate irritating skin conditions of the ear of the user.

Figure 5A:
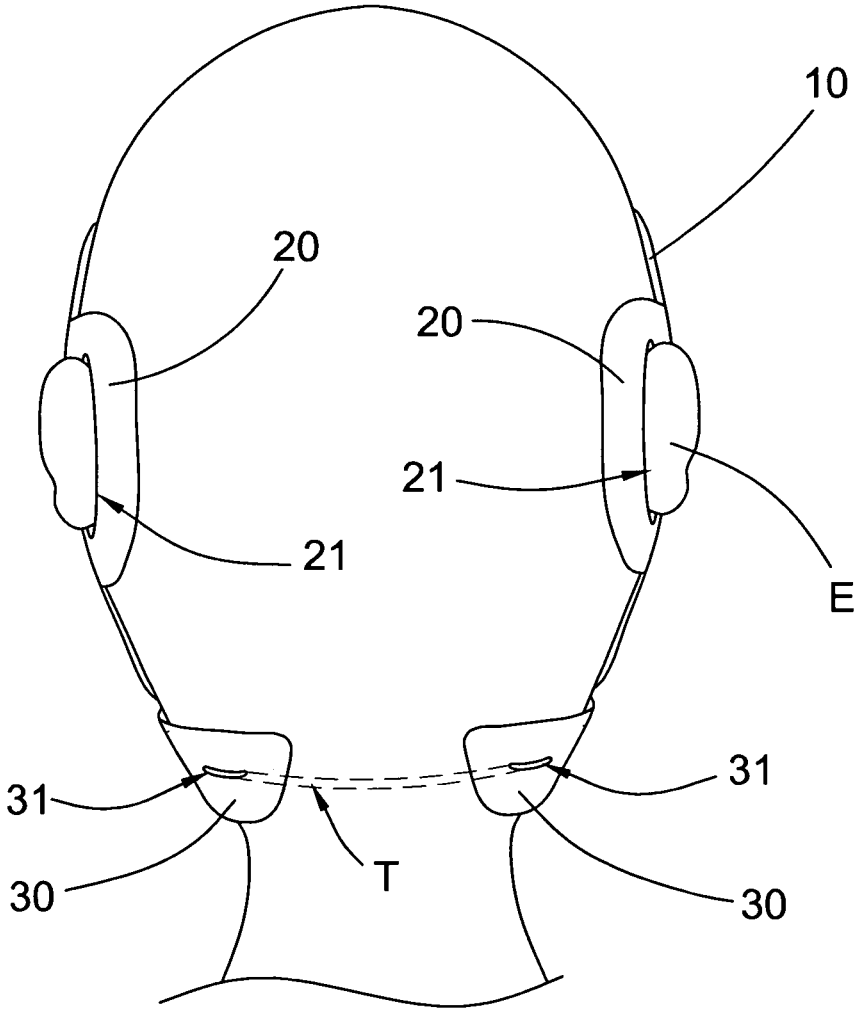
FIG. 5A is a rear view of the facial mask applied to the user according to the above preferred embodiment of the present invention, illustrating the covering of the rear skin surfaces near the rear portions of the ears of the user by the ear mask layers of the facial mask.
Figure 5B:
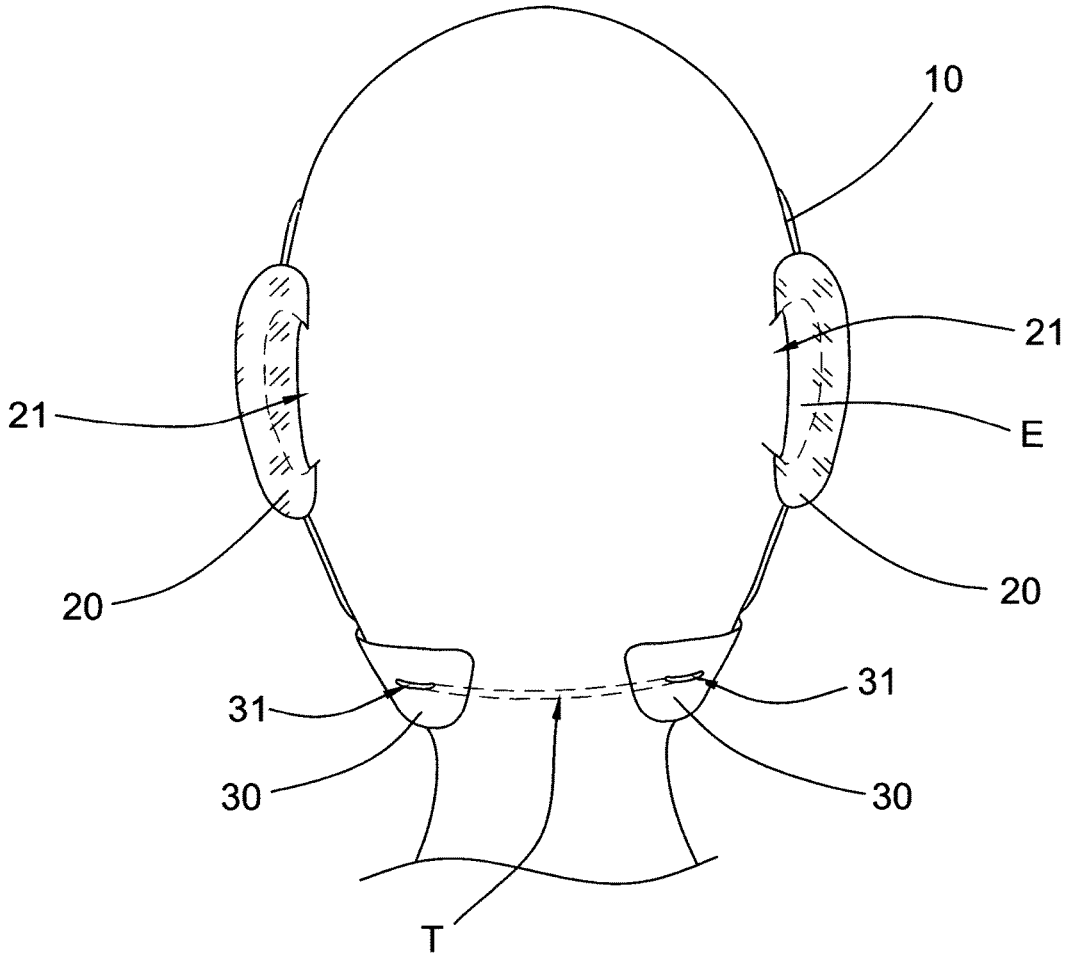
FIG. 5B is a rear view of the facial mask applied to the user according to the above preferred embodiment of the present invention, illustrating the covering of the rear ear skin surfaces of the ears of the user by the ear mask layers of the facial mask.

As shown in FIGS. 1 and 2, each of the ear mask layers 20 has an arc configuration adapted for the arc shape of the ear and defines two ends spacedly and integrally extended from the corresponding side portion of the facial mask layer 10 and an ear wearable slot 21 between the two ends thereof. Please further referring to FIGS. 4, 5A and 5B, the ear wearable slots 21 are arranged to enable the ears E of the user passing therethrough respectively so as to wear the facial mask layer 10 on the face F of the user and, simultaneously, to extend the ear mask layers 20 to the rear portions of the user's ear respectively for covering the skin surfaces near the ears E, as shown in FIGS. 4 and 5A, or folding back the ear mask layers 20 to cover the rear ear skin surfaces of the ears E, as shown in FIGS. 2 and 5B. According to the preferred embodiment, each of the ear wearable slots 21 is an elongated slot having an arc shape for facilitating the ear E of the user to pass therethrough and a width enabling the user's ear for fittingly looping and hanging on the respective ear of the user so as to securely hang the facial mask in position on the face of the user while enabling the user to have normal activities, such as walking around, sitting down, and laying down, with the facial mask of the present invention worn on his or her face.

It is worth mentioning that the ear mask layers 20, integrally extended from the facial mask layer 10, can be stretched sidewardly to increase the distance between the two side portions thereof, i.e. the width of the facial mask layer 10, via the ear mask layers 20. In other words, when the ear mask layers 20 are held by the ears of the user, the ear mask layers 20 provide two opposite pulling forces at the facial mask layer 10 along a center axis A thereof at the same time. As a result, the facial mask layer 10 can be fittingly overlaid and ensure a complete coverage of the skin surface of the face of the user.

In addition, the cosmetic composition 40 soaked or impregnated in the facial mask body will also provide an adhesive effect between the facial mask layer 10 and the skin surface of the face of the user to ensure the cosmetic composition 40 to be in good, firm and direct contact with the skin surface of the user's face. At the same time, as shown in FIGS. 1, 2, 4, 5A, and 5B, when the ear mask layers 20 are held by the ears E of the user, reaction forces will also pull the ear mask layers 20 toward the facial mask layer 10 that helps the ear mask layers 20 to fittingly overlay on the rear ear skin surfaces E1 of the user's ears E respectively (as shown in FIGS. 2 and 5B) or on the rear skin surface E2 near ears E of the user (as shown in FIGS. 4 and 5A), while the adhesive effect of the cosmetic composition 40 ensures a good and direct contact between the ear mask layers 20 and the rear ear skin surfaces E1 of the user's ears E or the rear skin surfaces E2 near the user's ears E.

As shown in FIGS. 1, 2 and 4 the chin mask layer 30, which is integrally extended from a bottom portion of the facial mask layer 10, is arranged to be folded inwardly for covering a skin surface of the user's chin under the jaw of the user for ameliorating irritating skin conditions of the skin surface of the user's chin, as shown in FIG. 4. According to the preferred embodiment of the present invention, the chin mask layer 30 may further have two side wing portions 31 sidewardly extended from the two opposing sides of the chin mask layer 30 respectively, such that the side wing portions 31 of the chin mask layer 30 are adapted for inwardly folding to cover two side portions of the skin surface of the chin of the user towards the ears, as shown in FIGS. 1 and 4.

The chin mask layer 30 further has two holding slots 32 formed at the two side wing portions 31 respectively, wherein when the side wing portions 31 of the chin mask layer 30 are long enough to extend to the ears of the user while folding inwardly to cover the skin surface of the user's chin under the jaw, the holding slots 32 function as ear holding slots to loop and hang on the two ears of the user respectively to ensure the chin mask layer 30 in good, firm and direct contact with the skin surface of the user's chin, as shown in FIG. 2.

It is worth mentioning that the chin mask layer 30 can be enlarged to further cover the skin surface of the neck of the user. Alternatively, when two side wing portions 31 of the chin mask layer 30 are long enough, the chin mask layer 32 can be directly wrapped around the neck the user to cover the skin surface of the user's neck while simply tying up the two ends of the two side wing portions 31 or utilizing a thread or the like T to hold the two side wing portions 31 together through the two holding slots 32 at the back of the neck, as shown in FIGS. 4, 5A and 5B. In other words, it is worth mentioning that when the two side wing portions 31 of chin mask layer 30 are not long enough to reach the ears of the user, the user may use a connector T, such as a thread or an elongated piece of paper, to connect the two side wing portions 31 through the two holding slots 32.

Similar to the ear mask layers 20, the side wing portions 31 of the chin mask layer 30 are stretched sidewardly when the side wing portions 31 are held by the ears of the user via the ear holding slots 32 according to the embodiment as shown in FIG. 2, or by connecting with the connector T through the ear holding slots 32 according to another embodiment as shown in FIGS. 4, 5A and 5B. Therefore, the pulling forces of the side wing portions 31 along the center axis A of the facial mask layer 10 will ensure the chin mask layer 30 to fittingly overlay on the chin skin surface of the user. In addition, the cosmetic composition 40 will also provide an adhesive effect between the chin mask layer 30 and the chin skin surface of the user to ensure the cosmetic composition 40 being directly in contact with the chin skin surface of the user. The pulling forces of the side wing portions 31 of the chin mask layer 30 will also stretch and firm the muscle at the chin area below the jaw of the user.

As shown in FIGS. 1 and 3, the facial mask of the present invention further comprises a composition retention structure 50 for retaining the cosmetic composition 40 on the mask body through surface tension effect. Accordingly, the composition retention structure 50 has a plurality of composition retention apertures 51 spacedly formed on the mask body. In other words, the composition retention apertures 51 are provided in the facial mask layer 10, the ear mask layers 20, and the chin mask layer 30 in such a manner that, when the mask body is impregnated or soaked with the cosmetic composition 40, the cosmetic composition 40 is retained in each of the composition retention apertures 51 due to surface tension so as to enable the cosmetic composition 40 to be in good and direct contact with the skin surface of the user directly, including the skin surfaces of the face, the rear ear portions and the chin portion of the user. In other words, the surface tension of the cosmetic composition 40 in the composition retention apertures 51 can hold the cosmetic composition 40 within each of the composition retention apertures 51. As a result, the fluid retention power of the mask body of the present invention is formed not only by the absorbability of the material of mask body itself but also by the surface tension effect of the cosmetic composition 40 in each of the composition retention apertures 51.

According to the preferred embodiment, the composition retention structure 50 further comprises a thickened retention brim 52 integrally formed at the mask body to encircle around each of the composition retention apertures 51. In other words, the composition retention aperture 51 is defined within the retention brim 52. According to the preferred embodiment, each of the retention brims 52 is thicker than the mask body not only to enhance absorption of the cosmetic composition 40 but also to ensure the cosmetic composition 40 to be retained in the composition retention aperture 51 through the surface tension effect. Therefore, more cosmetic composition 40 can be absorbed by the retention brim 52, such that a greater surface tension of the cosmetic composition 40 can be provided at the composition retention aperture 51 within the retention brim 52.

The composition retention structure 50 further comprises a plurality of tension bridges 53 spacedly formed within each of the composition retention apertures 51 for enhancing the surface tension of the cosmetic composition 40 therein. Accordingly, each of the tension bridges 53 is integrally extended between one side of the retention brim 52 to the opposed side thereof to across the composition retention aperture 51. Therefore, when the cosmetic composition 40 is filled at the composition retention aperture 51, the tension bridges 53 therewithin will enhance the surface tension of the cosmetic composition 40 in order to firmly hold the cosmetic composition 40 at the mask body. Since the surface tension of the cosmetic composition 40 will retain itself on the mask body, the cosmetic composition 40 will not be dropped down from the mask body by gravity.

It is worth mentioning that once the mask body overlaps on the skin surface of the user, the surface tension of the cosmetic composition 40 will disappear, such that the cosmetic composition 40 can directly contact and penetrate through the skin surface of the user.

According to the preferred embodiment, the mask body is preferably made of absorbent fabric being woven by stretchable materials, including but not limited to gauzed, knit, weavable non-woven, and synthetic threads. Accordingly, the mask body has a predetermined thickness that integrates the ear mask layers 20 and the chin mask layer 30 with the facial mask layer 10. In addition, the thickness of the retention brim 52 can be larger than the thickness of the mask body and the tension bridge 53 can be made of thread like material.

It is worth mentioning that the mask body can be made of re-useable material that the mask body is able to be washed by water and dried after every use. Then, the clean mask body is impregnated or soaked with cosmetic composition 40 or any facial skin care treatment composition. In other words, when the mask body is dried, the mask body can be re-impregnated with different kinds of cosmetic compositions 40. In other words, different kinds of cosmetic compositions 40 can provide different functions of facial treatments, so the mask body can provide different functions of facial treatments. It is appreciated that the mask body can be made of disposable material as well.

It is appreciated that the facial mask of the present invention can be made with the mask body without impregnated or soaked with cosmetic composition 40. The user may have his or her homemade prescription of cosmetic composition or purchase necessary cosmetic composition from the market and then soak or impregnate the mask body with the cosmetic composition 40 or apply cream or gel form skin care product or any other concentrated thick consistency textured formulations to the inner surface of the mask body by himself or herself while the skin care product or self prepared cosmetic composition can be well retained by the composition retention structure 50.

According to the preferred embodiment, as shown in FIG. 1, the eye openings 11, the nose opening 12 and the mouth opening 13 are holes with predetermined size.

Figure 1A:
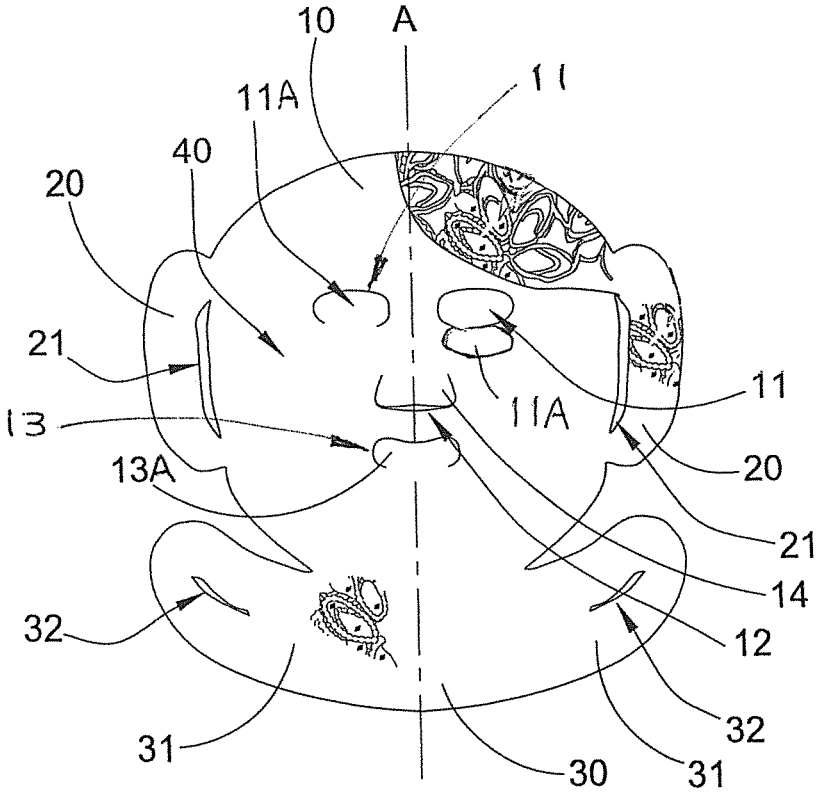
FIG. 1A is a perspective view of the facial mask according to an alternative mode of the above preferred embodiment of the present invention.

However, it is appreciated that each of the eye openings 11 and the mouth opening 13 can be alternatively formed by providing a U-shaped cut in the facial mask layer 10 to form a flip portion 11A, 13A, as shown in FIG. 1A, so that the user may fold up (if the connecting portion of the flip portion 11A, 13A with the facial mask layer 10 is at the upper position) or fold down (if the connecting portion of the flip portion 11A, 13A with the facial mask layer 10 is at a lower position as shown in FIG. 1A) the flip portion 11A, 13A to form a hole as the eye opening 11 or mouth opening 13 with desired size for the eyes or mouth of the user to communicate with outside. The user may also control the size of the eye openings 11 and the mouth opening 13 by flipping different amount of the flip portion 11A, 13A. It is also worth mentioning that when the flip portions 11A, 13A is folded down, the cosmetic composition 40 impregnated in the flip portions 11A, 13A substantially enables the puffiness under the eyes and the chin portion under the mouth of the user to have a double amount of cosmetic composition 40 provided by the facial mask layer 10 and the respective flip portions 11A, 13A.

According to the present invention, a wearing method for the mask body of the facial mask of the present invention is provided, which comprises the following steps.

(A) Place the facial mask layer 10 of a facial mask on the face of the user to overlay the facial mask layer 10 on the skin surface of the face of the user. In one embodiment, the wearing method further comprises a step of aligning the two eye openings, the nose opening and the mouth opening provided in the facial mask layer with the two eyes, nose and mouth of the user.

(B) Pull the two ear mask layers 20 sidewardly and hang the two ear mask layers to the ears of the user by passing the ears of the user through the two ear wearable slots 21 of the two ear mask layers respectively so as to wear the facial mask layer 10 to fittingly cover the skin surface of the face of the user.

In one embodiment, the wearing method further comprises a step of overlaying the two ear mask layers 20 on the rear ear skin surfaces E1 of the two ears of the user respectively by folding the two ear mask layers 20 to cover the rear ear skin surfaces E1 of the two ears E of the user respectively.

In one embodiment, the wearing method further comprises a step of overlaying the two ear mask layers 20 on the rear skin surfaces E2 near the rear portions of the two ears of the user respectively by extending the two ear mask layers 20 to cover the rear skin surfaces E2 near the rear portions of the two ears E of the user respectively.

(C) Fold the chin mask layer 30 inwardly and pull the two side wing portions 31 of the chin mask layer 30 sidewardly to overlay the chin mask layer 30 on the chin skin surface of the user under the jaw thereof.

In one embodiment, the wearing method of the present invention further comprises a step of extending the two side wing portions 31 of the chin mask layer 30 toward the two ears E of the user and hang the two side wing portions 31 on the two ears of the user by passing the ears E of the user through the two holding slots 32 of the two side wing portions 31 of the chin mask layer 30 respectively so as to securely hold the chin mask layer 30 as well as the facial mask layer 10 in position.

In one embodiment, the wearing method of the present invention further comprises a step of connecting the two side wing portions 31 of the chin mask layer 30 with a connector T, such as a thread or the like, so as to securely hold the chin mask layer 30 as well as the facial mask layer 10 in position.

The holding device, including the ear mask layers 20 and/or chin mask layer 30, of the present invention not only enables the user to wear the facial mask easily and securely holds the facial mask in position during application while enabling the user's normal activities, but also provides facial skin care effect to the skin surfaces of the ears and the chin of the user.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A wearable facial mask, comprising:

a mask body, which comprises: a facial mask layer having a size and a shape adapted for covering a face of a user while enabling the user to breathe normally;

a holding device which comprises two ear mask layers extended from two side portions of said facial mask layer to hold said facial mask layer in position to cover the face of the user by hanging to two ears of the user respectively; and a composition retention structure provided in said facial mask layer and said holding device for retaining a cosmetic composition in said facial mask layer and said ear mask layers for treatment of the skin surface of the face and ear portions of the user when said mask body is worn on the face of the user, wherein said composition retention structure comprises:

a plurality of composition retention apertures spacedly formed in said facial mask layer in a manner that when said facial mask layer is impregnated with said cosmetic composition, said cosmetic composition is retained within each of said composition retention apertures due to surface tension so as to enable said cosmetic composition to be directly in contact with the skin surfaces of the user;

at least a thickened retention brim integrally formed at said facial mask layer to encircle around each of said composition retention apertures, wherein said thickened retention brim is thicker than said mask body that a thickness of said thickened retention brim is larger than a thickness of said mask body, such that said thickened retention brim enhances an absorption of said cosmetic composition being retained within said composition retention aperture and provides a greater surface tension of cosmetic composition within said composition retention aperture; and a plurality of tension bridges spacedly formed within each of said composition retention apertures for enhancing the surface tension of said cosmetic composition therein, wherein each of said tension bridges is integrally extended between one side of said retention brim to an opposed side thereof to across said composition retention aperture.

2. The wearable facial mask, as recited in claim 1, wherein said holding device of said mask body further comprises a chin mask layer extended from a bottom portion of said facial mask layer, wherein said composition retention structure is provided in said chin mask layer for retaining cosmetic composition for treatment of the skin surface of the chin of the user when said mask body is worn on the face of the user.

3. The wearable facial mask, as recited in claim 2, wherein said chin mask layer has two side wing portions sidewardly extended from two opposing sides of said chin mask layer respectively for enlarging the contact area of the skin surface of the chin of user and ensuring said facial mask layer overlays on the face of the user.

4. The wearable facial mask, as recited in claim 1, wherein each of said ear mask layers has an ear wearable slot provided therein which is sized and shaped for enabling the respective rear of the user to pass through and looping and hanging on the respective ear of the user while said ear mask layers are adapted for selectively overlaying on two rear ear skin surfaces of the ears of the user respectively or overlaying on two rear skin surfaces near the ears of the user respectively.

5. The wearable facial mask, as recited in claim 3, wherein each of said ear mask layers has an ear wearable slot provided therein which is sized and shaped for enabling the respective rear of the user to pass through and looping and hanging on the respective ear of the user while said ear mask layers are adapted for selectively overlaying on two rear ear skin surfaces of the ears of the user respectively or overlaying on two rear skin surface near the ears of the user respectively.

6. The wearable facial mask, as recited in claim 3, wherein each of said side wing portions of said chin mask layer has a holding slot, wherein said two holding slots are sized and shaped for selectively looping and hanging to the two ears of the user respectively or enabling a connector to connect said chin mask layer via said two holding slots so as to hold said facial mask layer and said chin mask layer in position.

7. The wearable facial mask, as recited in claim 5, wherein each of said side wing portions of said chin mask layer has a holding slot, wherein said two holding slots are sized and shaped adapted for selectively looping and hanging to the two ears of the user respectively or enabling a connector to connect said chin mask layer via said two holding slots so as to hold said facial mask layer and said chin mask layer in position.

8. The wearable facial mask, as recited in claim 1, wherein said mask body is made of stretchable and absorbent fabric being woven by stretchable material that said thickened retention brim is made of thread being woven to increase the thickness thereof, such that when said mask body is worn, said facial mask layer and holding device are stretched for ensuring said facial mask layer overlays on the skin surface of the user.

9. The wearable facial mask, as recited in claim 2, wherein said mask body is made of stretchable and absorbent fabric being woven by stretchable material that said thickened retention brim is made of thread being woven to increase the thickness thereof, such that when said mask body is worn, said facial mask layer and holding device are stretched for ensuring said facial mask layer overlays on the skin surface of the user.

10. The wearable facial mask, as recited in claim 5, wherein said mask body is made of stretchable and absorbent fabric being woven by stretchable material that said thickened retention brim is made of thread being woven to increase the thickness thereof, such that when said mask body is worn, said facial mask layer and holding device are stretched for ensuring said facial mask layer overlays on the skin surface of the user.

11. The wearable facial mask, as recited in claim 7, wherein said mask body is made of stretchable and absorbent fabric being woven by stretchable material that said thickened retention brim is made of thread being woven to increase the thickness thereof, such that when said mask body is worn, said facial mask layer and holding device are stretched for ensuring said facial mask layer overlays on the skin surface of the user.

* * * * *